US008402803B2

(12) United States Patent
Creuzet

(10) Patent No.: US 8,402,803 B2
(45) Date of Patent: Mar. 26, 2013

(54) STAMPING-EXTRUSION PROCESS AND DEVICE

(75) Inventor: Yvon Creuzet, Marmande (FR)

(73) Assignee: SOFTEL, Marmande (FR)

( * ) Notice: Subject to any disclaimer, the term of this patent is extended or adjusted under 35 U.S.C. 154(b) by 338 days.

(21) Appl. No.: 12/601,432

(22) PCT Filed: May 21, 2008

(86) PCT No.: PCT/EP2008/056290

§ 371 (c)(1),
(2), (4) Date: May 4, 2010

(87) PCT Pub. No.: WO2008/145591

PCT Pub. Date: Dec. 4, 2008

(65) Prior Publication Data

US 2010/0236313 A1 Sep. 23, 2010

(30) Foreign Application Priority Data

May 25, 2007 (FR) ..... 07 55255

(51) Int. Cl.
*B21C 25/08* (2006.01)

(52) U.S. Cl. ..... 72/260; 72/257

(58) Field of Classification Search ..... 72/260, 72/263, 266, 267, 257, 271, 272
See application file for complete search history.

(56) References Cited

U.S. PATENT DOCUMENTS

| | | | | |
|---|---|---|---|---|
| 1,789,675 | A | 2/1928 | Elias | |
| 3,691,811 | A | 9/1972 | Heitman et al. | |
| 4,662,205 | A | 5/1987 | Ratte | |
| 6,190,595 | B1 * | 2/2001 | Thoms et al. | 264/177.16 |
| 7,069,760 | B2 * | 7/2006 | Jin | 72/260 |
| 7,389,668 | B2 * | 6/2008 | Nakamura et al. | 72/264 |
| 2004/0020260 | A1 * | 2/2004 | Jin | 72/260 |

FOREIGN PATENT DOCUMENTS

| | | |
|---|---|---|
| EP | 1652598 | 5/2006 |
| JP | 11-114618 | 4/1999 |

OTHER PUBLICATIONS

International Search Report dated Aug. 6, 2008.

* cited by examiner

*Primary Examiner* — Faye Francis
(74) *Attorney, Agent, or Firm* — RatnerPrestia

(57) ABSTRACT

The subject of the invention is a device and a process for producing single-piece parts, including a bulk section and an elongated section, the device includes a die, formed from at least two half-shells, provided with an orifice for introducing material and bearing as a hollow the shape of the bulk section of the part, at least one of the two half-shells includes an extrusion orifice for producing the elongated section of the part. The process includes a step of pushing a slug of material into a die, provided with an inlet orifice and bearing as a hollow, the shape of the bulk section of the part, and a step of extruding a fraction of the slug to produce the elongated section of the part through an extrusion orifice of the die so as to form a blank of the part via a stamping-extrusion operation.

15 Claims, 3 Drawing Sheets

STAMPING-EXTRUSION PROCESS AND DEVICE

This application claims priority of PCT International Application No. PCT/EP2008/056290 filed on May 21, 2008. The contents of which are incorporated herein by reference.

FIELD OF THE INVENTION

The present invention relates to a method for manufacturing metal parts, particularly one-piece parts comprising a bulky portion and an elongated portion using a device and a method that will be called stamping-extrusion.

BACKGROUND

The manufacture of metal parts such as the half-frames of aircraft structural box assemblies is conventionally carried out by forging a preliminary blank approaching the general shape of the frame and then machining the preliminary blank in order to achieve constant thickness, quenching and pressing to obtain a final blank ready to be machined.

The manufacturing cycle also comprises, after forging, a machining operation for producing constant thickness in order to press the preliminary blank in an even manner after the quenching operation, the pressing being used to prevent deformations during machining and at the end a final machining.

The half-frames of aircraft structural box assemblies and in particular the half-frames of the central structural box assembly forming the junction between the fuselage and the wings are metal parts which comprise a relatively bulky foot in the form of a spade and a curved, elongated tail.

The conventional method mentioned above has the drawback of generating considerable wastage since, for example, for half-frames of the central structural box assembly comprising a spade that is of the order of 1300 mm long, 500 mm wide and 80 mm thick and a tail of the order of 2600 mm long and with a section of 80×80 mm curved at a radius of the order of 2000 to 3000 mm, a preliminary blank weighing approximately 450 kg is necessary to produce a part which, in the end, will weigh only approximately 30 to 50 kg.

This is due to the fact that, despite the skill of the metalworkers, the extra thicknesses necessary to produce the preliminary forge blank remain considerable.

In addition, this method takes several hours because two machining steps and one compacting step are necessary in addition to the forging step.

SUMMARY OF THE INVENTION

The object of the present invention is to reduce material wastage, to simplify and accelerate the production of this type of one-piece part comprising two portions of markedly different shape, and in particular a bulky portion and an elongated portion.

For this purpose, the present invention proposes a device for producing one-piece metal parts comprising a bulky portion and an elongated portion, which comprises a mold, formed of at least two half-shells, provided with a material supply aperture and supporting as a recess the shape of the bulky portion of the part, at least one of the half-shells comprising an aperture for extruding the elongated portion of the part.

It also proposes a method for producing one-piece parts comprising a bulky portion and an elongated portion, which comprises a step of pushing a billet of material into a mold provided with a supply aperture supporting as a recess the shape of the bulky portion of the part, and a step of extruding a fraction of the billet in order to produce the elongated portion of the part through an extrusion aperture of the mold in order to form a blank of the part via a stamping-extrusion operation.

BRIEF DESCRIPTION OF THE DRAWINGS

Other features and advantages of the invention will be apparent on reading the following description of exemplary embodiments of the invention with reference to the drawings which represent.

DETAILED DESCRIPTION

Figure 1:
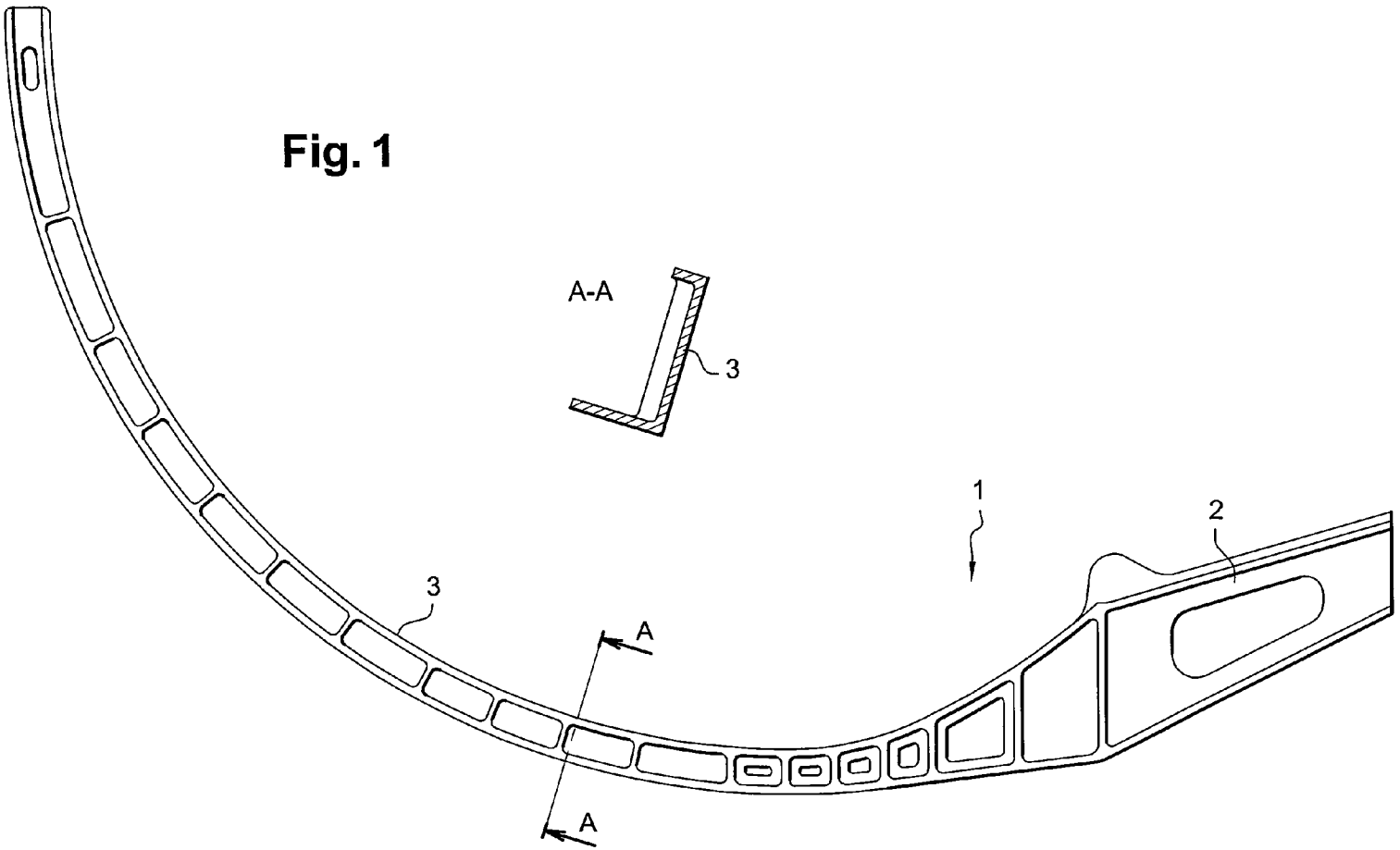
in FIG. 1: a top view of an example of a part that can be made with the device and the method of the invention.

The invention relates to a device for producing one-piece parts 1 such as, for example, the part 1 corresponding to an aircraft structural frame represented in FIG. 1 and comprising a bulky portion 2 and an elongated portion 3 in the form of a section piece.

Such a part is produced from a solid preliminary blank which is machined in order to give it its final shape.

Such a part, as has been explained above, is conventionally produced from a forged preliminary blank which leads to generating considerable wastage.

The present invention markedly reduces the wastage by allowing the production of a blank as closely as possible approaching the bulk of the part to be produced and in which all that remains to do is to machine the final shape of the section piece.

Figure 2:
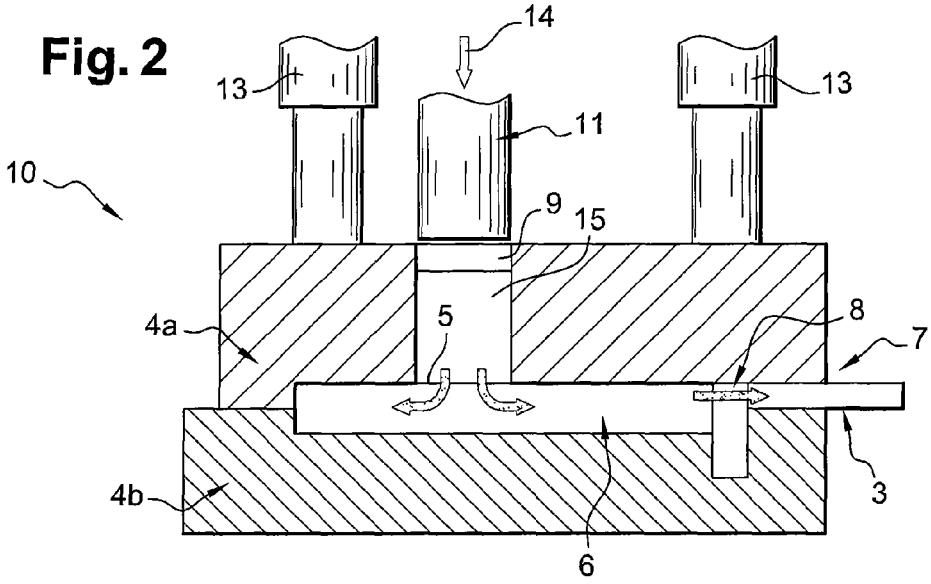
in FIG. 2: a schematic side view in section of a device according to the invention.
Figure 3:
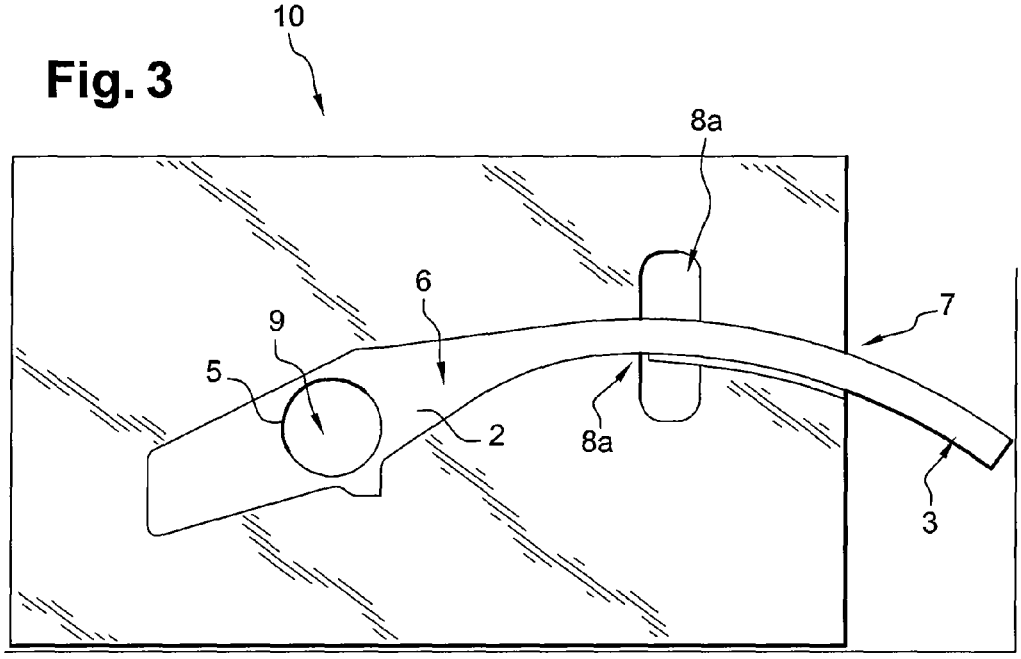
in FIG. 3: a schematic top view of the device of FIG. 2.

The device as schematized in FIGS. 2 and 3 comprises a mold formed of at least two half-shells 4*a*, 4*b* supporting as a recess 6 the shape of the bulky portion of the part being used as a blank of the section piece.

One of the half-shells 4*a* is provided with a material supply aperture 5 leading into the top portion of the half-shell, on the upper surface of the opposite half-shell at the parting line between the two half-shells.

At least one of the half-shells of the mold comprises an extrusion aperture 7 for producing the elongated portion 3 of the part.

The extrusion aperture comprises a die 8, 8*a*, 8*b* formed so as to produce the elongated portion 3 in the form of a bent section piece.

Figure 4:
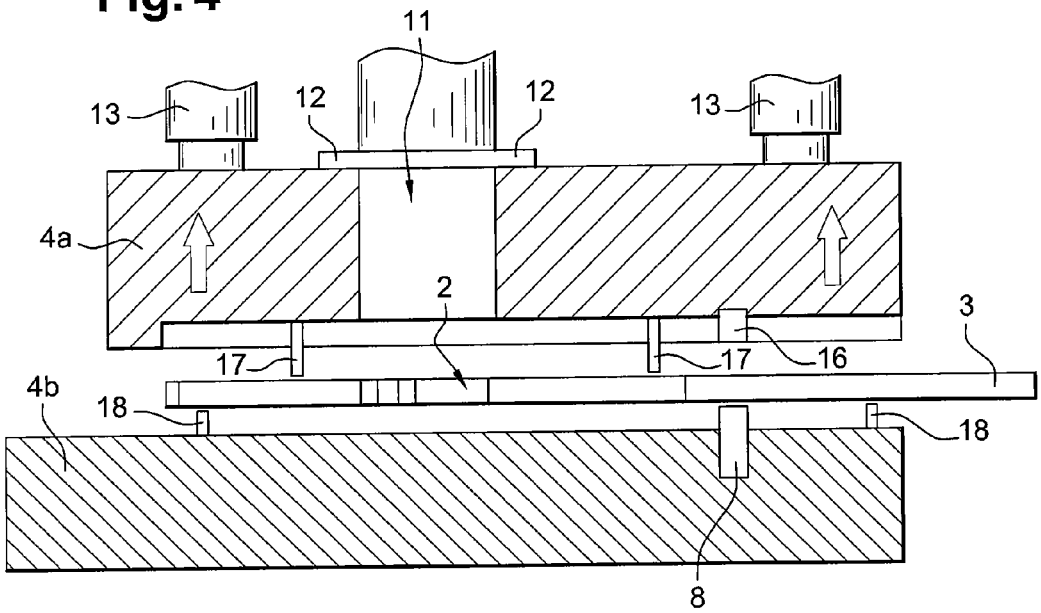
in FIG. 4: a schematic side view in section of a variant device of FIG. 2 in the part-ejection position.

According to the example, the die is placed in the lower half-shell 4*b*, and protrudes beyond the parting line between the two half-shells to fit into a housing 16 of the upper half-shell 4*a* as shown in FIG. 4.

Moreover, FIG. 4 corresponds to an exemplary embodiment for which the lower half-shell is flat, the reverse shape of the part being produced in the upper half-shell.

Figure 5:
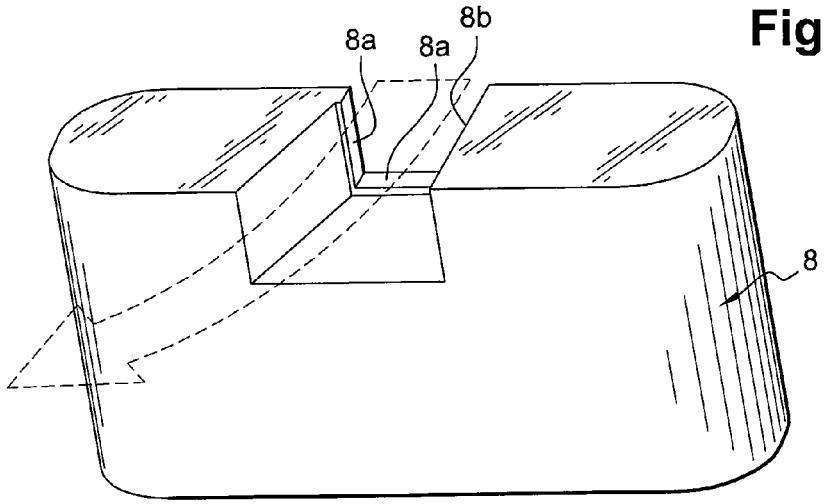
in FIG. 5: a detail in perspective of a die according to one embodiment of the invention.

The die shown schematically in FIG. 5 comprises a guide 8*b* leading with the curvature of the aperture 7 to the bending of the portion 3 of the part.

The die comprises an edging 8*a* constraining the material coming out of the aperture in order to produce the dimensions of the elongated portion of the part.

The die 8 is advantageously removable in order to produce, by replacement of dies, parts for which the elongated portion is more or less curved or bulky.

The device, as depicted in FIG. 2, comprises a container 9 for supplying the mold, leading into the material supply aperture 5 made in the mold.

This container 9 comprises an internal volume designed in order to receive a billet of material of sufficient volume to produce the whole part so that the mold is empty at the beginning of production of the part.

Specifically, unlike the conventional stamping methods for which the mold is opened to receive a preliminary blank of the part to be produced and then closed again in order to press the material between the half-shells, the billet of material is not placed in the mold before the operation but is placed in the container 9 in order to be subsequently pushed into the mold that is already closed.

The container 9 is advantageously a cylindrical container receiving a ramrod piston 11, suitable for pushing the material from the container 9 into the mold and filling it, then continuing to push the material until it causes a portion designed to produce the elongated portion 3 to come out of the extrusion aperture.

To limit the travel of the piston and avoid deforming the part at the end of production, the half-shell 4*a*, according to FIG. 4, comprising the supply aperture 5 and/or the ramrod piston is provided with abutment means 12 for stopping the ramrod piston 11.

With billets of calibrated volume, this makes it possible to stop the extrusion in a precise manner which increases the precision of the blank produced.

One of the requirements of the device of the invention is to ensure a correct closure of the mold before injecting the material from the reservoir.

For this, the example shown comprises a double-acting press for closing 13 the mold and for pushing 14 the piston 11.

The power ratio of the press is preferably 1 to 2 between the power necessary to move the piston 11 and the power necessary to close the mold, the higher power being that used to keep the mold closed.

The method for producing one-piece parts 1, comprising a bulky portion 2 and an elongated portion 3, according to the invention comprises a step of pushing a billet 15 of material into the mold 4*a*, 4*b*, provided with a supply aperture 5 and supporting as a recess the shape of the bulky portion 2 of the part.

The base material of the billet is of cylindrical shape prepared in advance and heated to a temperature close to the temperature for extruding the alloy that will be used.

Once the material has sufficiently filled the recessed shape between the two half-shells, the method continues with a step of extruding a fraction of the billet in order to produce the elongated portion 3 of the part through the extrusion aperture 7 of the mold.

Therefore, a blank of the part is obtained via a stamping-extrusion operation, the bulky portion of the part being stamped between the two half-shells, the elongated portion being extruded at the extrusion aperture of the mold.

Prior to the stamping and the pushing step, the billet 15 is placed in a container 9 for supplying the mold, connected to the supply aperture leading into the mold, and the container, billet and mold assembly is heated to a temperature close to the optimal temperature for plastic deformation of the material of the billet.

During the pushing step, the material is compressed and is pushed toward the supply aperture 5 at a first pressure, so that the material deforms and supplies the mold, then the material is compressed at a second pressure higher than the first so that a portion of the material comes out via the extrusion aperture 7 made in the mold.

As an example, for a billet of an alloy of 71/75 zinc chrome aluminum type, a temperature close to the optimal temperature for plastic deformation is a temperature coming close to the temperature of melting the alloy which is 480° C.±5° C.

In practice, the minimum temperature used for such an alloy is 350° C.

The temperature to be used differs depending on the alloys that it is desired to work and on the compaction that it is desired to make the alloy sustain.

The compaction consists in deforming the metal by causing a squeezing and an orientation of the metal crystals by the action of a work of deformation in one or more preferred directions. It is influenced by the working temperature of the alloy. A good temperature regulation of the device is therefore necessary to ensure a correct repetitivity of the parts produced.

One of the advantages of the invention over the forging/machining of the prior art is that the compaction ratio obtained at the die is favorable for the mechanical properties of the section piece.

The device and the method of the invention therefore make it possible, in addition to reducing wastage, to notably reduce the time to produce the parts from several hours, according to the conventional methods, to a few tens of minutes for the steps of the method of the present invention preceding the final machining of the section piece.

The pressures applied by the piston are considerable and the material is compressed slowly by the piston called a ramrod piston with a first pressure of 2000 to 3000 bars. The material deforms slowly under the effect of the pressure and the temperature and initially supplies the whole mold with a relatively low pressure of 2000 to 3000 bars in the mold.

When the mold is full, the pressure rises to cause the material to come out of the mold through the aperture of the die.

In the case of the example, the pressure rises up to 6000 to 7000 bars and the material comes out through the die until the necessary length of the curved section piece is obtained. The ramrod, at the end of the stamping-extrusion operation, butts against the edge of the mold which serves as an end-of-travel and for creating the thickness of the frame foot.

The position of the supply aperture is chosen to be in a central zone, preferably of greater width, of the bulky portion in order to obtain an even distribution of material in the bulky portion.

As has been seen above, the mold comprises half-shells 4*a*, 4*b* and the half-shells are pressed one against the other in order to close the mold before the stamping-extrusion operation and before inserting material between the half-shells. A third pressure is then applied to the half-shells 4*a*, 4*b* forming the mold during the stamping-extrusion operation so as to keep the mold closed throughout the operation.

In the context of the invention, it is however possible to envisage a mechanical closure of the half-shells.

Finally, to produce a curved section piece, the extrusion operation is carried out by means of a curved die 8, 8*a*, 8*b* which produces an operation for bending the elongated portion 3 of the part at the same time as the extrusion operation.

Throughout the operation, the assembly is heated to the optimal temperature for plastic deformation of the alloy and maintained, by autonomous heating, thermocouples and regulation.

In addition to the advantage of a very considerable saving in material at this temperature and production time-saving, the method supplies an intensive hot compaction which allows a very marked improvement in the mechanical characteristics of the frame and a much better fiber structure of the alloy at the inception of the frame at the exit from the foot.

When the part is finished, the mold is opened by actuating the cylinders 13 which raise the upper half-shell and the part is taken out with conventional ejection means such as a system of ejectors 17 installed in the upper half-shell and/or pushers 18 in the lower mold which raise the finished stamped part, as shown schematically in FIG. 4, the part being finally removed by lifting and translation.

In addition to the advantage of a very considerable saving in material and production time, the method applying an intensive triaxial stress at the correct temperature allows a very marked improvement in the mechanical characteristics of the frame and a much better fiber structure at the inception of the frame at the exit from the foot.

The manufacturing method of the invention makes it possible to reduce the current cost price of a central structural box assembly frame by 50 to 60%.

It advantageously replaces the conventional methods for manufacturing airframes by forging or machining in the solid material.

The invention claimed is:

1. A method for producing a part made of a single material, the part comprising a bulky portion and an elongated portion, the method comprising the steps of:

placing a billet of the material into a container;

pushing the billet of the material from the container into a mold, the mold being provided with a supply aperture in communication with the container and having a cavity of a volume corresponding to the bulky portion of the part;

extruding a fraction of the billet in order to produce the elongated portion of the part through an extrusion aperture of the mold; and opening the mold to extract the bulky portion of the part.

2. The method as claimed in claim 1, further comprising, before the step of pushing the billet, the steps of:

placing the billet in a container for supplying the mold, said container being connected to the supply aperture leading into the mold and the container; and heating the billet and mold assembly to a temperature close to the optimal temperature for plastic deformation of the material of the billet.

3. The method as claimed in claim 1, wherein, during the step of pushing the billet, the material is compressed and is pushed toward the supply aperture at a first pressure, so that the material deforms and fills the cavity of the mold, then the material is compressed at a second pressure higher than the first pressure so that a portion of the material comes out via the extrusion aperture made in the mold.

4. The method as claimed in claim 3, wherein the first pressure is a pressure of the order of 2000 to 3000 bar.

5. The method as claimed in claim 3, wherein the second pressure is a pressure of the order of 6000 to 7000 bar.

6. The method as claimed in claim 1, wherein, the mold comprising half-shells, the method comprises the step of pressing the half-shells one against the other in order to close the mold before the stamping-extrusion operation.

7. The method as claimed in claim 1, wherein, the mold comprising half-shells, the method comprises the step of applying a third pressure to the half-shells during the stamping-extrusion operation so as to keep the mold closed.

8. The method as claimed in claim 1, comprising the step of carrying out an extrusion operation by means of a curved die which produces an operation for bending the elongated portion of the part at the same time as the extrusion operation.

9. The method as claimed in claim 1, wherein the step of pushing the billet and the step of extruding are done together with a control of the temperature, pressure and flow speed of the material in the cavity.

10. A method for forming a metal part having a bulky portion and an elongated portion comprising the steps of:

closing an empty two part mold having a cavity in communication with a container at a supply aperture leading into said cavity of the mold, said mold comprising an extrusion aperture on another side of said cavity;

placing a billet formed of a metal in said container having an internal volume of sufficient volume to produce the whole metal part;

pushing said metal from said container into said mold and filling said mold to create said bulky portion; and continuing to push the material until it causes a portion designed to produce said elongated portion to come out of the extrusion aperture.

11. A method for forming a metal part having a bulky portion and an elongated portion as claimed in claim 10 further comprising the step of stopping a pushing piston at the communication interface between the container and the mold to limit the travel of the piston and avoid deforming the part located within the mold.

12. A method for forming a metal part having a bulky portion and an elongated portion as claimed in claim 10 further comprising the step of releasing a pressure within the mold and opening the mold to extract said metal part.

13. A method for forming a metal part having a bulky portion and an elongated portion as claimed in claim 10 comprising the steps of:

compressing the metal during the step of pushing;

pushing the metal toward the supply aperture at a first pressure, so that the metal deforms and fills the mold; and compressing the metal at a second pressure higher than the first pressure, so that a portion of the metal comes out via said extrusion aperture.

14. A method for forming a metal part having a bulky portion and an elongated portion as claimed in claim 10 comprising the step of compacting the metal in deforming the metal by causing a squeezing and an orientation of the metal crystals by the action of a work of deformation in one or more preferred directions.

15. A method for forming a metal part having a bulky portion and an elongated portion as claimed in claim 10 comprising the step of regulating at least one of temperature, flow speed and pressure in the mold and container.

* * * * *

UNITED STATES PATENT AND TRADEMARK OFFICE

CERTIFICATE OF CORRECTION

PATENT NO. : 8,402,803 B2
APPLICATION NO. : 12/601432
DATED : March 26, 2013
INVENTOR(S) : Yvon Creuzet It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 501 days.

Signed and Sealed this
First Day of September, 2015

Michelle K. Lee

Michelle K. Lee
*Director of the United States Patent and Trademark Office*